US007987564B2

(12) United States Patent
Leeder

(10) Patent No.: US 7,987,564 B2
(45) Date of Patent: Aug. 2, 2011

(54) URN COLUMN

(76) Inventor: Stefan Leeder, Salzburg (AT)

( * ) Notice: Subject to any disclaimer, the term of this patent is extended or adjusted under 35 U.S.C. 154(b) by 0 days.

(21) Appl. No.: 12/592,846

(22) Filed: Dec. 3, 2009

(65) Prior Publication Data

US 2010/0139060 A1 Jun. 10, 2010

(30) Foreign Application Priority Data

Dec. 4, 2008 (EP) ..... 08021065

(51) Int. Cl.
*A61G 17/00* (2006.01)

(52) U.S. Cl. ..... 27/1; 27/35; 52/136

(58) Field of Classification Search ..... 27/35, 1, 27/2; 52/103, 104, 128, 134, 136, 137, 133; 211/85.27; 40/124.5
See application file for complete search history.

(56) References Cited

U.S. PATENT DOCUMENTS

| | | | | |
|---|---|---|---|---|
| 834,204 | A * | 10/1906 | Hodges | 52/137 |
| 951,493 | A * | 3/1910 | Benshaw | 52/137 |
| 1,964,234 | A * | 6/1934 | Vogel | 52/141 |
| 3,581,452 | A * | 6/1971 | Jalbert | 52/133 |
| 3,898,718 | A * | 8/1975 | Eubank | 27/35 |
| 4,328,606 | A * | 5/1982 | Nunes | 27/35 |
| 6,421,890 | B1 * | 7/2002 | Biggar | 27/1 |
| 6,904,721 | B1 * | 6/2005 | Forbes | 52/103 |
| 7,036,195 | B2 * | 5/2006 | Glass | 27/1 |
| 7,458,138 | B2 * | 12/2008 | Spiers et al. | 27/29 |
| 7,478,461 | B2 * | 1/2009 | Glass | 27/1 |
| 2002/0144383 | A1 * | 10/2002 | Spence | 27/35 |

FOREIGN PATENT DOCUMENTS

DE 100 01 506 A1 7/2001

* cited by examiner

*Primary Examiner* — William L. Miller
(74) *Attorney, Agent, or Firm* — Miller, Canfield, Paddock and Stone; Mark L. Maki

(57) ABSTRACT

The invention relates to an urn column, consisting of a segment (0) with a hollow body (1) which serves to receive and store a plurality of urn capsules (2). The urn capsules (2) are wrapped in urn carrier bags (3) with vertically adjustable carrying straps (4), and inserted into the upper cavity opening (5), suspended one above the other, extending from the bottom up. In so doing, each urn carrier bag (3), filled with the urn capsule (2), is fastened with vertically adjustable carrying straps (4) to the upper suspension annulus (6) and fixed in its particular position in the hollow body (1) of the urn column. The suspension annulus (6) is firmly connected to the upper cavity opening (5) of the urn column and both are covered with a cover (7) in any desired form. On the urn column surface the marking (8) of the urn column contents is provided by means of a suspension apparatus (9) which permits the attachment of flower vase holders (10) and grave candle holders (11). The bottom anchoring is effected via a concrete foundation (12) to permit a space-saving, vertical erection of the urn column on any desired ground.

7 Claims, 3 Drawing Sheets

URN COLUMN

BACKGROUND OF THE INVENTION

This invention relates to an urn column for burial purposes.

Urn capsules are integrated into so-called memorial urns or decorative urns. Said urns are immured in urn wall niches or buried in earth urn graves. There is already known from DE 100 01 506 A1 a grave memorial which serves to store urn capsules outdoors. Said grave memorial is divided into segments, each urn requiring a separately divided-off space. A disadvantage of such a grave memorial consists in the fact that, although it permits a spatially separated commemoration, it involves an increased space requirement inside the cavity through end pieces.

The solution to the problem is effected by the features stated below. Also described are preferred embodiments of the inventive urn column.

The space requirement of the inventive urn column is many times lower compared to previous urn storage systems in the form of grave memorials.

Hereinafter the invention will be explained more closely by way of example with reference to the attached drawing.

DETAILED DESCRIPTION OF THE PREFERRED EMBODIMENT

Figure 1:
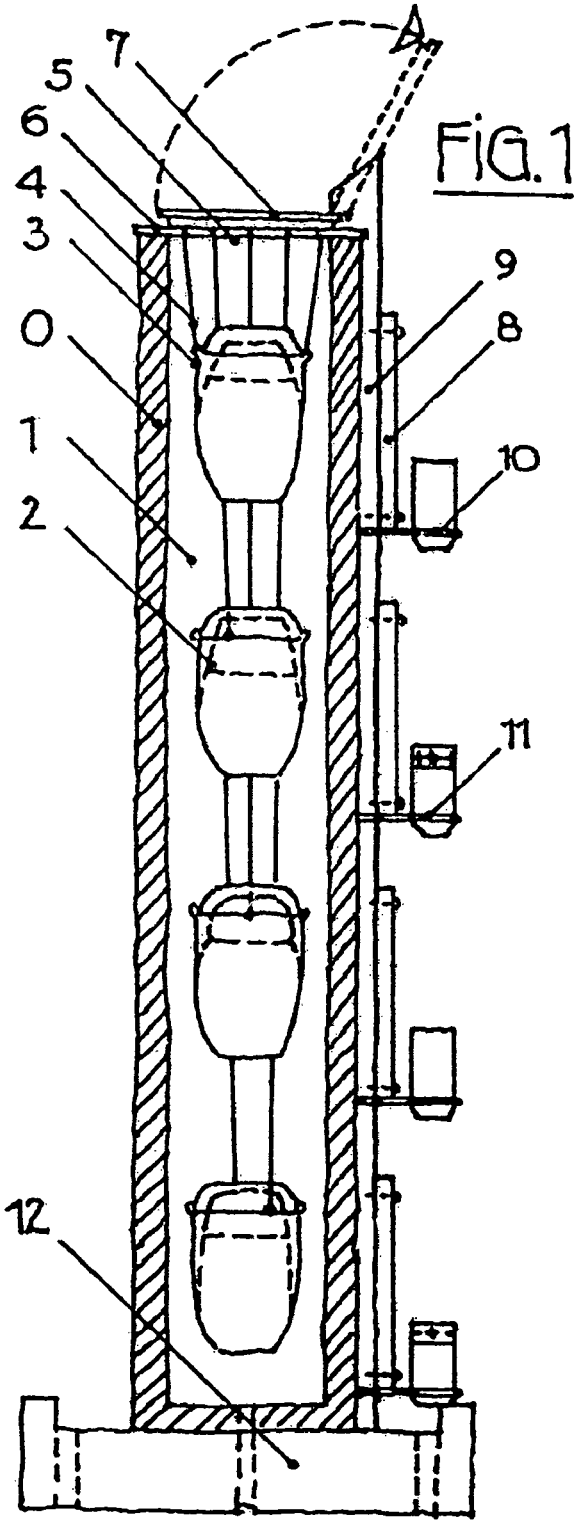
FIG. 1 shows a free-standing, vertical urn column in plan view.
Figure 2:
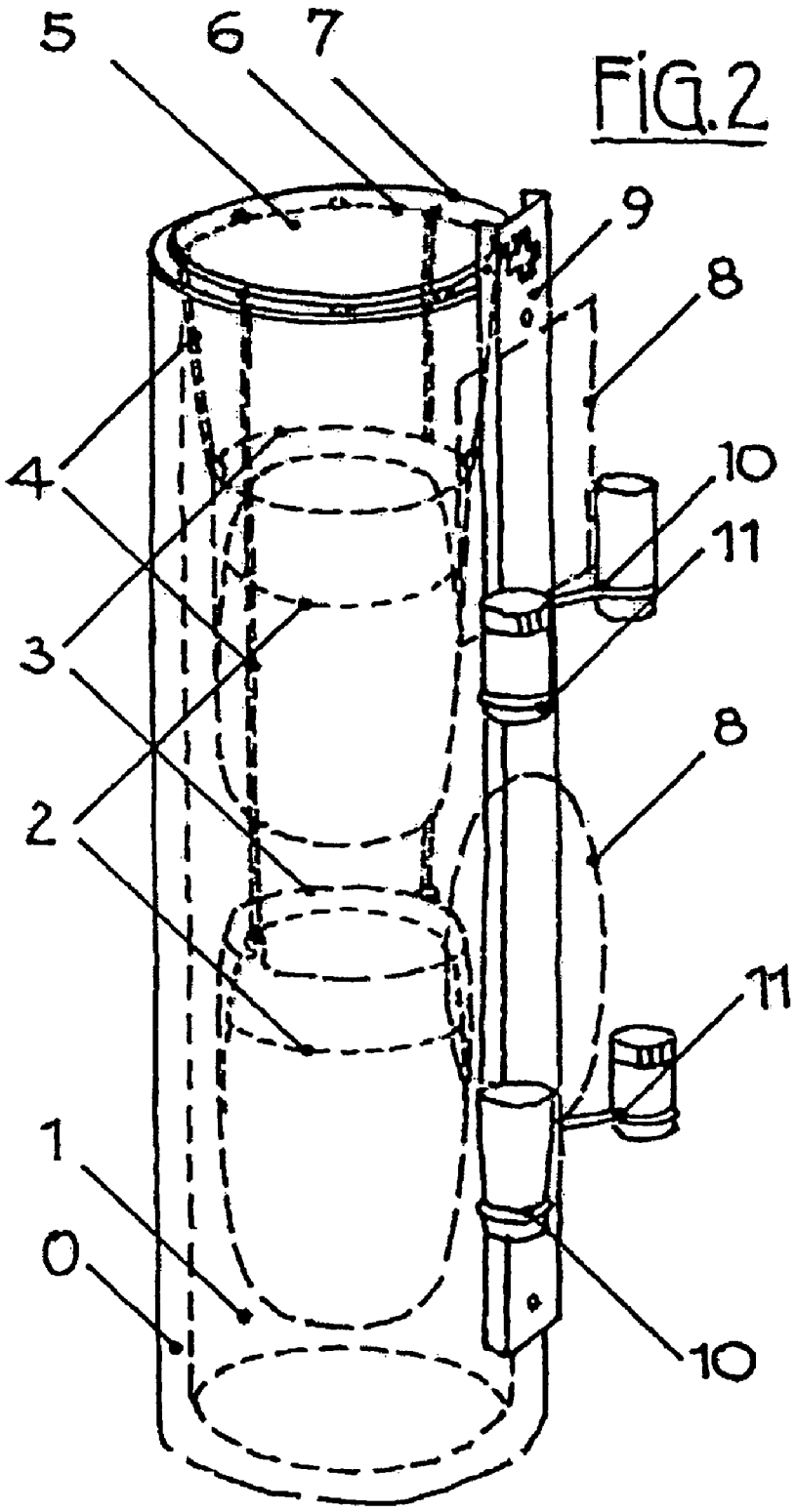
FIG. 2 shows the suspension one above the other and the position of the urn carrier bags (3) with enwrapped urn capsules (2) in the cavity (1) of the urn column.
Figure 3:
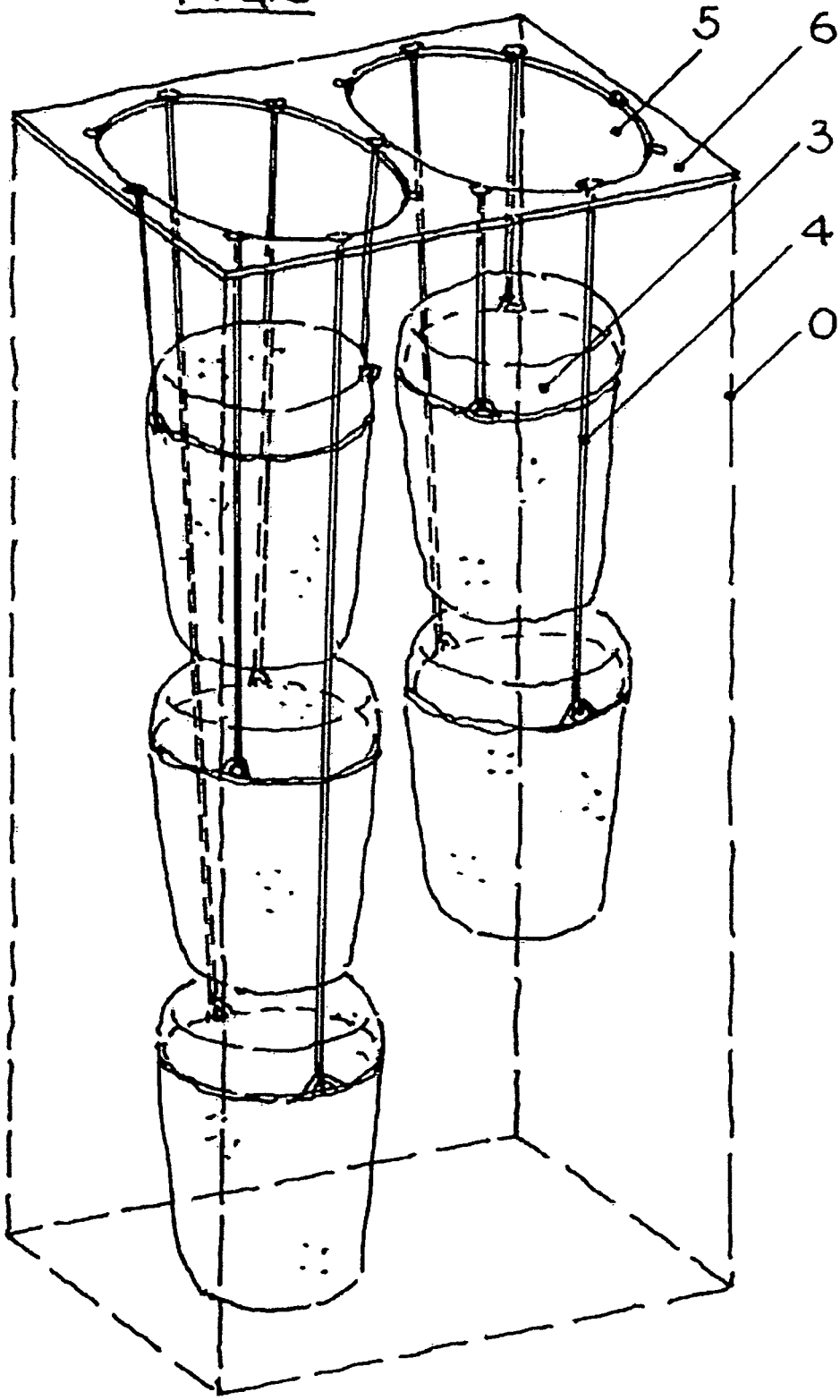
FIG. 3 shows a plurality of urn carrier bags (3) with vertically adjustable carrying straps (4) which are connected to the suspension annulus (6).

Each urn capsule (2) is wrapped in a textile urn carrier bag (3) with vertically adjustable carrying straps (4). Through insertion into the upper column opening (5) and a suspension of the urn capsules (2) one above the other, extending from the bottom up, by means of the urn carrier bags (3), said cavity (1) is to be utilized as a repository for burial purposes in the municipal and private burial and cemetery sector. The column opening (5) at the upper end of the segment (0) of the urn column is placed on by means of a suspension annulus (6), which is designed in any desired form and material, and serves as a suspension apparatus for the textile urn carrier bags (3) with vertically adjustable carrying straps (4). The suspension annulus (6) is covered by a cover (7) in any desired form and material. In the cover (7) there is located a colored light source which stores its energy with solar cells and emits light in darkness. The urn column is anchored with a base plate (12) and can be placed on any ground.

The space requirement of previous urn storage systems in the form of a grave memorial is many times greater compared to inventive urn columns.

In the exemplary embodiment, the inventive urn column is constructed as follows:

Urn column (FIG. 1) in circular, oval, triangular, quadrangular, pentagonal, hexagonal, octagonal or polygonal form and different dimensions. The material can consist of natural stone, cast stone, standard concrete or terrazzo concrete and can be colored in many variants. The surface design can be, as desired, smooth-formed, ground, brushed, roughened, sandblasted, polished, painted or pasted. The urn column is marked on its outer side with a suspension apparatus (9) for attachment of commemorative plaques (8) and grave ornaments such as candle holders (11), flower vase holders (10) or the like. The urn column stands on a concreted base or precast concrete part and can be transferred to the landscape in any desired form.

The invention claimed is:

1. An urn column for storage of urn capsules for burial purposes, comprising:

a segment with a cavity and a column opening at an upper end of the segment;

said urn capsules each in a receiving means and suspended one above the other, extending from a bottom up, in the cavity, the receiving means being comprised of an urn carrier bag in which the respective urn capsule is wrapped and said urn carrier bag having vertically adjustable carrying straps.

2. The urn column according to claim 1, wherein the urn capsules are suspended in the cavity in a vertically adjustable fashion.

3. The urn column according to claim 1, and further comprising a suspension annulus for fastening the receiving means said suspension annulus disposed at the column opening.

4. The urn column according to claim 3, wherein the suspension annulus is closeable by a cover disposed at the column opening.

5. The urn column according to claim 1, and further comprising a suspension apparatus for marking the urn capsules disposed on an outer side of the segment.

6. The urn column according to claim 5, wherein the suspension apparatus is connected to a flower vase holder.

7. The urn column according to claim 5, wherein the suspension apparatus is connected to a grave candle holder.

* * * * *